US006823620B2

(12) United States Patent
Nagel

(10) Patent No.: US 6,823,620 B2
(45) Date of Patent: Nov. 30, 2004

(54) PLASTIC LABEL HOLDER WITH INTEGRAL SIGN HOLDER

(75) Inventor: Thomas O. Nagel, Blairstown, NJ (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 10/396,032

(22) Filed: Mar. 25, 2003

(65) Prior Publication Data

US 2003/0182835 A1 Oct. 2, 2003

Related U.S. Application Data

(62) Division of application No. 09/876,657, filed on Jun. 7, 2001, now Pat. No. 6,708,436.

(51) Int. Cl.[7] ..... G09F 3/18

(52) U.S. Cl. ..... 40/661.07; 40/661.03; 40/5

(58) Field of Search ..... 40/661.03, 661.07, 40/661.08, 640, 642, 666, 642.01, 642.02, 649, 5, 651; 211/94.01; D40/44; 24/336, 563, 564; 248/231.8; 218/231.8, 221.4, 223.41; D20/44

(56) References Cited

U.S. PATENT DOCUMENTS 4,557,064 A * 12/1985 Thompson ..... 40/661.03
5,392,547 A * 2/1995 Mason ..... 40/661.06
5,456,034 A * 10/1995 Lewis et al. ..... 40/666
6,026,603 A * 2/2000 Kump et al. ..... 40/661.03
D424,120 S * 5/2000 Wear ..... D20/43
6,266,906 B1 * 7/2001 Nagel ..... 40/661.03
6,299,004 B1 * 10/2001 Thalenfeld et al. ..... 211/184
D454,373 S * 3/2002 Kosir ..... D20/44

OTHER PUBLICATIONS

Copy of FFR Invoice No. 219363, dated Apr. 10, 1998 relating to Part No. 4403230701 (together with sample of sample of Part No. 4403230701).
One page excerpt from FFR catalog, dated prior to May 21, 1999, showing Part No. 4401921601.
Four page excerpt of Fast Indusstries "Catalog 2000", believed to have been published in 1999 or early 2000, re Sign Holders.

* cited by examiner

*Primary Examiner*—Frantz F. Jules
(74) *Attorney, Agent, or Firm*—Schweitzer Cornman Gross & Bondell LLP

(57) ABSTRACT

A shelf-front label holder is provided with a specifically improved form of auxiliary sign clip along its upper front edge. The label holder is formed of a relatively rigid plastic material, and the sign clip includes a downwardly extending portion overlying the upper front margin of the label holder to accommodate upward insertion of special sign tags. A thin, flexible tongue-like retaining element extends across a lower portion of the sign clip and is adapted to be easily deflected by upward insertion of a paper sign but thereafter lightly grips the sign to hold it in place. A new process is also disclosed for the continuous extrusion of the new label holder product, enabling the continuous co-extrusion of the soft, flexible tongue-like retaining element together with the main section of the label holder.

2 Claims, 3 Drawing Sheets

FIG. 2
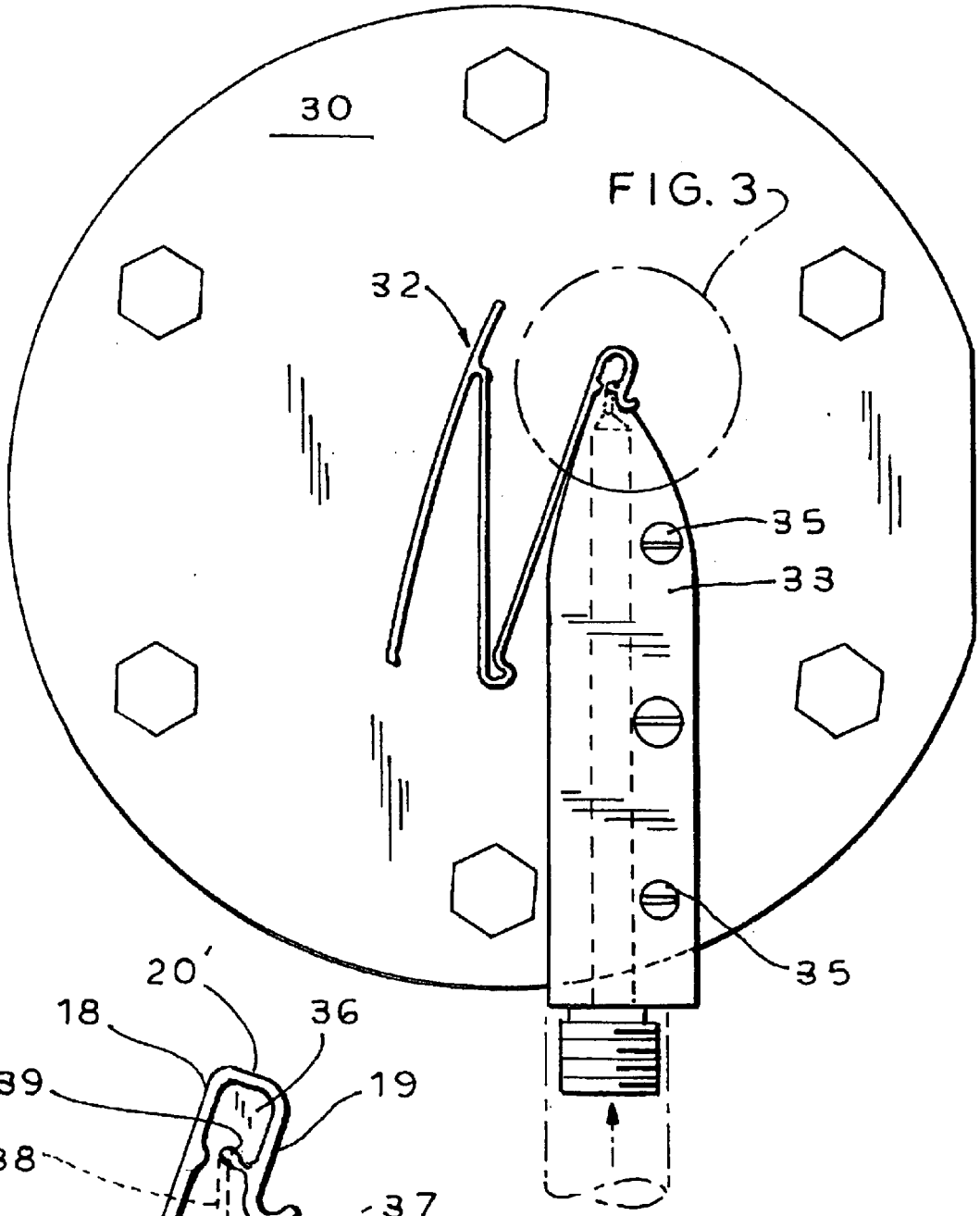
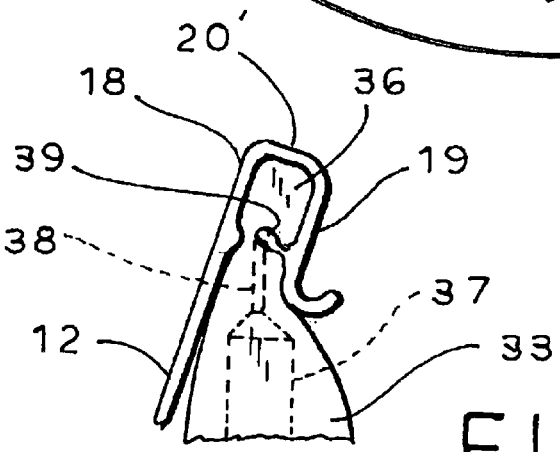
FIG. 3

PLASTIC LABEL HOLDER WITH INTEGRAL SIGN HOLDER

RELATED CASES

This application is a division of my application Ser. No. 09/876,657, filed Jun. 7, 2001 now U.S. Pat. No. 6,708,436, and is related to U.S. Pat. No. 6,266,906, granted Jul. 31, 2002.

BACKGROUND OF THE INVENTION

Mass merchandisers such as grocery chains, drug chains, discount department stores, and the like make extensive use of merchandise display shelving in which shelves are provided along their front edges with ticket moldings or data strips for displaying pricing and other information related to the displayed merchandise. In many modern installations, plastic strips are used in preference to extruded metal ticket moldings. In some instances, the plastic strips are constructed to be mounted within existing metal ticket moldings. In other cases, the strips are mounted directly to the front edge of the shelving.

One commonly used form of plastic data strip is comprised of a continuous extruded section of plastic material provided with a clear plastic front panel joined along its bottom edge to a back panel structure. The back panel structure may comprise a single panel, which is secured to the front edge of the shelving, or it may include an additional panel configured to be snapped into the front of a conventional metal ticket molding, for example. In either case, the clear front panel and the back panel structure form a continuous, upwardly opening label-receiving pocket for receiving pricing and information labels and the like.

It is a customary practice of stores of the type mentioned above to emphasize certain items in their displays, from time to time, such as new items, items that are featured on special sale, etc. Where conventional metal ticket moldings are employed, such special tags frequently are installed using plastic clips, which are inserted into the ticket molding, and provide a prominent display for the special tag. Where plastic data strips are utilized for the main pricing information, the special tags frequently are printed on thin, heat-bent plastic elements designed to be installed behind the clear front panel of the data strip. The special information can be printed on the plastic element, or on a paper tag which is enveloped within the special plastic element. In any case, these special plastic clips or elements involve undesirable added expense. While in some cases, they may be reused, they usually are thrown away after one or two uses. Moreover, the handling and storage of such reusable items is both an expense and an annoyance.

In the related case referred to above, a plastic data strip is provided along its upper front edge with a continuous, downwardly projecting overlay panel, joined integrally with the upper edge of the front panel, which forms a downwardly opening tag-receiving pocket along the uppermost edge margin of the front panel. The overlay panel is configured to converge with the surface of the front panel, to form a narrow throat, and thereafter to project forwardly to form a downwardly divergent entry. The overlay panel enables a thin, inexpensive and disposable printed paper tag to be inserted anywhere along the entire length of the data strip, by inserting an upper edge portion of the paper tag underneath the overlay panel. When the special tag has served its purpose, it can simply be removed and discarded. The device of the related application advantageously is formed with a narrow bead of co-extruded soft plastic material along the narrow throat portion of the overlay panel to improve the gripping action of the tag-receiving pocket on a light paper tag inserted therein, without unduly resisting insertion of the tag during installation.

SUMMARY OF THE INVENTION

Because the special tag to be inserted under the overlay panel typically is thin and flimsy, it is important that the overlay accommodate easy upward insertion of the tag while at the same time providing reliable retention of the tag by gripping its upper edge margin. These are somewhat mutually inconsistent requirements, in that the optimum arrangement requires a somewhat easier insertion of the tag than its removal. To accommodate this optimum performance desire, the display strip of the present invention incorporates an overlay panel construction in which the tag-holding clip includes a thin, highly flexible co-extruded tongue-like element of soft material which flexes easily to allow upward entry of the tag. At the same time, this flexible element effectively resists downward movement of the tag, unless intentional force is applied. In this respect, the soft, flexible tongue-like element advantageously is oriented to be inclined slightly upward, such that it is easily flexed upwardly for insertion of a thin paper tag. Downward movement of the tag, however, is resisted more strongly, as the flexible tongue-like element is displaced slightly downward, to extend more directly across the throat of the tag-holding clip and thus exert more retention force on the tag.

While the principal plastic data strip is extruded of a relatively hard plastic material, such as rigid polyvinyl chloride (PVC), the co-extruded tongue-like element is formed of a considerably softer material, typically a compatible soft PVC material. While co-extrusion of such materials, as a general proposition, is widely practiced, the display strip of the present invention presents a particularly difficult problem in the manufacture, because of the relatively tiny dimensions of the co-extruded tongue-like element.

In accordance with the invention, the co-extrusion process is in effect carried out in two stages. The primary strip, formed of so-called rigid PVC or other plastic material, is formed by extruding molten plastic material through an extrusion die of appropriate configuration, in a generally known manner, emerging from the extrusion die without the intended co-extruded tongue-like element. A second and separate extrusion die is placed on or immediately adjacent to the front face of the primary die and is positioned to be partly enveloped by the upper margin of the front panel of the display strip, on one side, and by the short clip-forming overlay panel, on the other side. Significantly, as the primary display strip emerges from its extrusion nozzle, the tag-holding clip portion thereof has a substantially wide-open configuration, allowing an upper portion of the second extrusion nozzle to be easily received within the downwardly opening recess formed along the upper edge of the display strip. At this juncture, the plastic material forming the principal part of the display strip is still in the form of a highly viscous, semi-liquid material. Immediately as this semi-liquid material emerges from its extrusion nozzle, it is joined by the flow of softer plastic co-extrusion material emerging from the second nozzle, so that the two materials are joined in a co-extrusion in a manner that enables the small, delicate tongue-like element to retain its desired shape and effectively prevents from being overwhelmed and deformed by the heavier section of the primary extrusion. Immediately following the second extrusion step, the co-extruded shape separates from the second extrusion die and is drawn under slight tension into a so-called calibrating die, which reshapes the strip into its desired, final cross-sectional configuration. While the material is traveling to and through the calibrating die, it is still extremely soft and pliable, and easily conforms to the desired final shape, including a closing of the tag-holding clip portion to its final configuration, with a narrow entrance throat closed by the co-extruded soft plastic tongue-like element. Typically, as the extruded section emerges from the downstream side of the calibrating die, it is immediately immersed in a cooling liquid to harden the plastic and permanently fix the final shape of the strip. The finished strip is then cut into suitable lengths, (typically four feet) for installation on standard store shelving.

The process of the invention enables truly unique and advantageous label display of product to be produced on a controlled, high production basis.

For a more complete understanding of the above and other features and advantages of the invention, reference should be made to the following detailed description of preferred embodiments of the invention, and to the accompanying drawings.

DESCRIPTION OF THE DRAWINGS

FIG. 2 is a front elevational view of a dual extrusion die arrangement according to the invention for a two-step co-extrusion of a label display strip with integral tag-holding clip.

FIG. 3 is an enlarged, fragmentary illustration of the encircled area of FIG. 2, showing details of the second-stage extrusion die.

DESCRIPTION OF PREFERRED EMBODIMENTS

Figure 1:
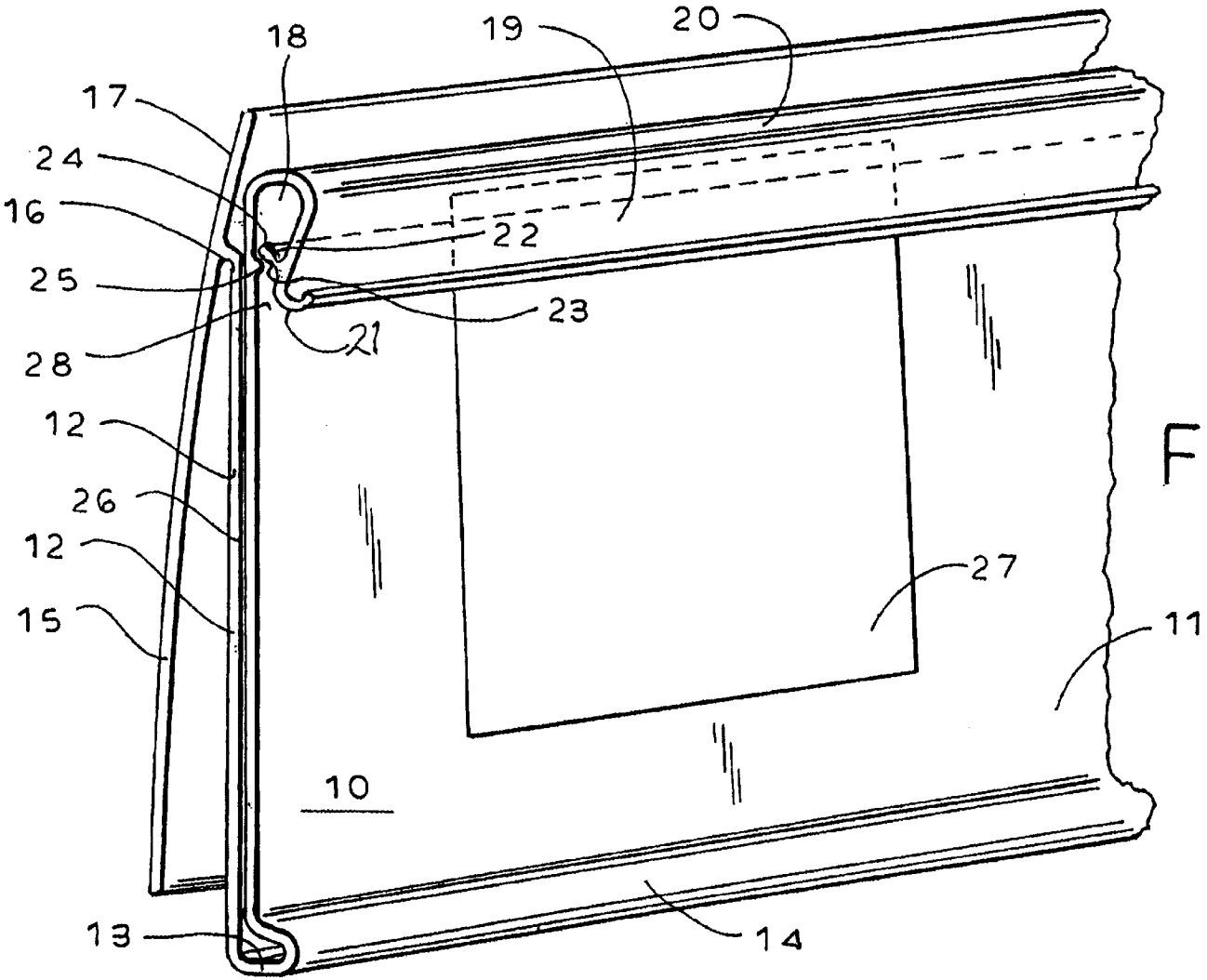
FIG. 1 is a front perspective view of a typical form of label display strip incorporating features of the invention and produced in accordance with the process of the invention.

Referring now to the drawings, a typical and advantageous form of label display strip according to the invention is illustrated in FIG. 1. Specific dimensions are not a part of the invention, although dimensions may be referred to herein for convenience and to indicate typical practices in the field. Label display strip 10 of FIG. 1 includes a front panel 11, formed of clear plastic material, and a first back panel 12, also formed of plastic material, but not necessarily clear. The front and back panels 11–12 are integrally joined at 13, along their bottom edges, forming an upwardly open pocket for the reception of information and pricing labels (not shown). Commonly, the structure of the lower edge area of the label-holding strip includes a short forward projection 14, which provides stress relief, and also functions as a guide flange for a barcode reader, for example.

In the illustrated form of the invention, a second back panel 15 is provided, integrally attached to the top edge portion 16 of the first back panel 12 and typically having a portion 17 extending above the upper edge of the back panel 12. Second back panel 15, where employed, provides a means for mounting the label display strip within the channel of a pre-existing metal price tag molding, frequently provided at the front edges of merchandise shelving. Where the shelving does not have a previous installation of the metal price tag molding, it may be expedient to eliminate the second back panel 15 and secure the label display strip directly to the front edge of a shelf by adhesive bonding of the back panel 12, for example. These are well-known alternatives in the art, and do not form part of the present invention.

In the illustrated and preferred form of the invention, the front panel 11 and back panels 12,15 preferably, are formed of a rigid polyvinyl chloride. A label display strip of around 1.25 inches in height may typically have a panel thickness of around 0.016 inch.

As indicated in FIG. 1, the upper margin 18 of the front panel is joined with a downwardly extending overlay panel 19, by means of a connecting top section 20. The overlay panel 19 extends downward and somewhat inward, and preferably terminates in an outturned guide flange 21. The upper margin 18, overlay panel 19, top section 20, and guide flange 21 are advantageously formed of the same rigid PVC material of which the main panels 11, 12 and 15 are formed.

Extending generally rearwardly from the overlay panel 19 is a tongue-like retaining element 22, which is formed of a soft, flexible polyvinyl chloride composition and is co-extruded with the overlay panel 19 in a manner to be described hereinafter. Desirably, the retaining element 22 may be of slightly narrower cross-section at its root 23, where it joins with the overlay panel, to provide for easy flexibility of the element 22.

As is evident in FIG. 1, the tongue-like retaining element 22 preferably is disposed at an upwardly inclined angle, and its distal edge 24 lightly touches the front surface of the upper panel margin 18. Preferably, the front panel 11 is formed with a small, forwardly projecting rib 25, which extends along the length of the label display strip below the free edge 24 of the tongue-like retaining element 22.

In typical use of the label display strip of FIG. 1, a normal pricing and information label is inserted therein by displacing the upper portion of the front panel 11 forwardly relative to the back panel 12, opening a pocket between those two panels. The label (not shown) is inserted downward into the pocket 26 between the panels and is retained therein when the front panel is released. The label is readily viewable through the clear, transparent front panel 11 of the display strip.

For calling special attention to selected items, a special tag 27, which may be printed on ordinary paper, for example, is inserted upwardly into the tag-holding clip formed by the elements 18–22. When the tag 27 is inserted upwardly into the clip, the upper edge of the tag engages the flexible tongue-like element 22 and displaces that element upwardly a sufficient distance to allow the upper margin of the tag to slide by. The upwardly inclined orientation of the tongue-like element 22 facilitates the insertion of tag 27, as will be appreciated. The inherent resilience of the retaining element 22 causes the upper margin of the tag 27 to be gripped between the front surface of the panel margin 18 and the free end 24 of the retaining element 22 just above the rib 25. Slight downward forces on the tag 27 will simply cause the retaining element 22 to exert its grip more firmly. Because of the upwardly inclined orientation, the retaining element tends to be displaced downwardly by downward forces on the tag 27. This causes the retaining element to increase its gripping force. The underlying rib 25 tends to limit the downward displacement of the retaining element as will be understood. While the tag 27 is thus reliably held in place in the tag-holding clip, nevertheless, it may be removed by intentional force applied downwardly to the tag, when its removal is desired.

Desirably, to impart a desired degree of flexibility, the tongue-like retaining element 22 has a projecting length substantially greater than its thickness. By way of example only, its projecting length may be approximately 0.045 inch, whereas its thickness may be approximately one third of its length. The throat area 28, defined between the front surface of the front panel 11, and the lower back edge area 28, defined between the front surface of the front panel 11 and the lower back edge area of the overlay panel, can be comfortably large to facilitate insertion of the special tag 27. For example, a throat width of about 0.03 is easily accommodated. The tag is thus easily inserted into the clip, meeting no resistance until it engages the flexible tongue-like element 22.

Figure 4:
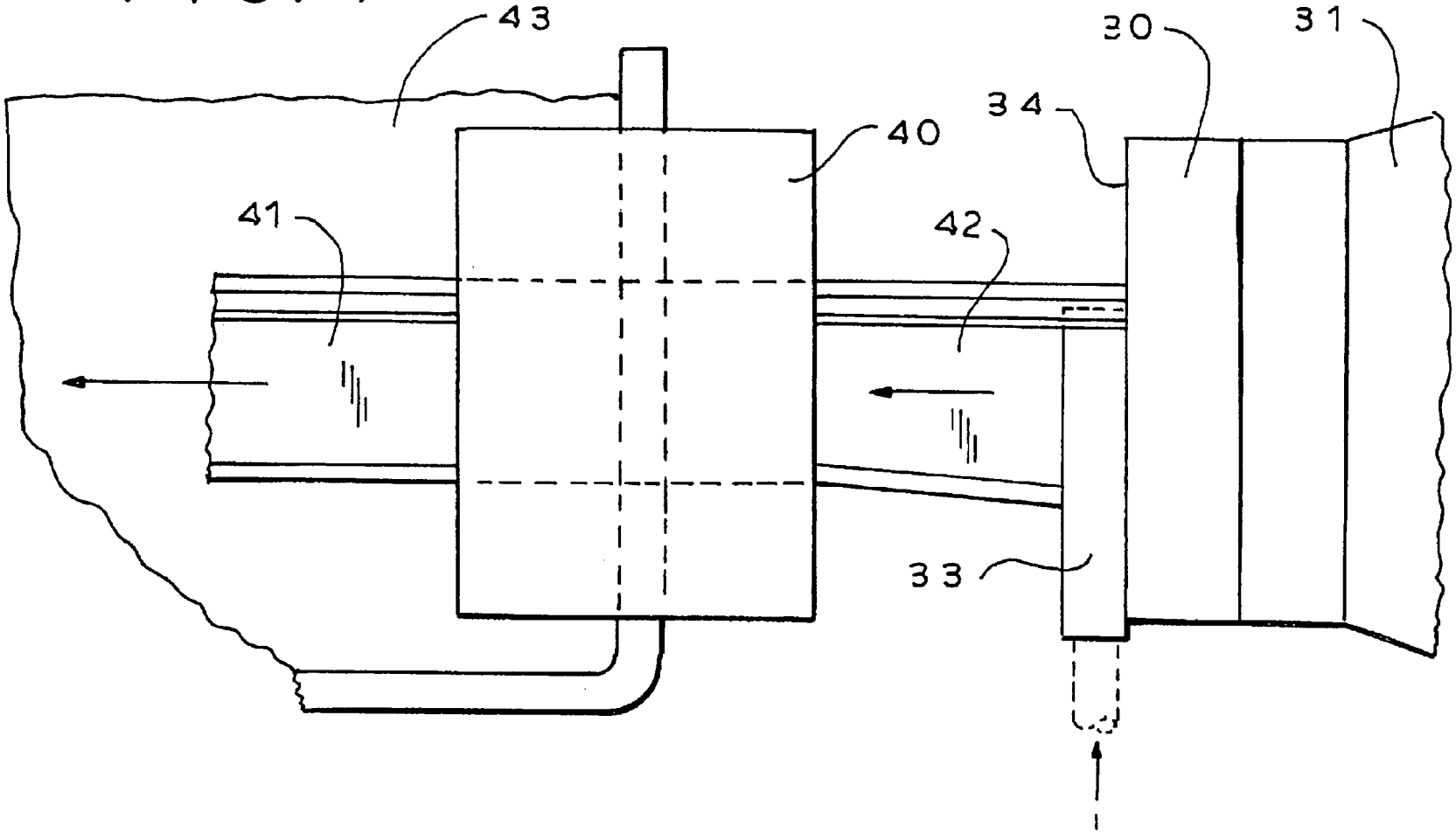
FIG. 4 is a schematic illustration of a two-step co-extrusion process according to the present invention.

Production of the described device pursuant to procedures of the invention involves a special two-stage co-extrusion procedure, in which the main body of the data strip is initially extruded from a primary extrusion nozzle and, immediately upon its emergence from the primary nozzle, and while the material of the strip body remains in semi-molten condition, the soft tongue-like element is co-extruded onto an inner surface of the overlay panel 19. With reference now to FIGS. 2–4, the reference numeral 30 designates generally the front face of a primary extrusion nozzle forming part of a conventional extrusion machine indicated generally by the reference numeral 31 in FIG. 4. The extrusion nozzle 30 is formed with an opening 32 having a cross sectional configuration generally related to that of the data strip 10 of FIG. 1. The configuration of the nozzle opening 32 is, however, laterally expanded in relation to the final configuration of the panels of the data strip and of somewhat larger dimensions. Thus, as the strip emerges from the extruder nozzle, it has the same, expanded cross sectional configuration as that of the nozzle opening 32.

Pursuant to the invention, the overlay panel 19 emerging from the primary extrusion nozzle is expanded away from the upper margin 18 of the back panel 12, as shown particularly in FIG. 3. This forms a wide, downwardly opening pocket between the panels 18, 19.

A secondary extrusion nozzle 33 is positioned immediately adjacent to the front face 34 of the primary extrusion nozzle, and preferably is fastened directly to the nozzle front face, by bolts 35. The upper extremity 36 of the secondary extrusion nozzle is received within the downwardly opening pocket defined by the overlay panel 19 and the upper panel margin 18. Desirably, the nozzle extremity 36 has cross sectional contours corresponding closely to the internal cross sectional configuration defined by the panel margin 18, overlay panel 19, and top section 20, as is evident in FIG. 3.

The secondary extrusion nozzle 33 is provided with internal supply passages 37, 38 communicating with the outer end of a discharge slot 39. The slot 39 is open at the front, and conveniently also at the back where the secondary nozzle is bolted directly to the front of the primary nozzle. The cross sectional configuration of the discharge slot 39, as viewed from in front of the primary extrusion nozzle 30, corresponds with the cross sectional configuration of the tongue-like retaining element 22. The discharge slot 39 is also open at one side of the nozzle extremity 36 facing a lower portion of the overlay panel 19.

The passages 37, 38 of the secondary extrusion nozzle 33 are supplied with the softer co-extrusion material (e.g., soft PVC) to form the tongue-like element 22. As is the material forming the more rigid portions of the data strip emerge from the primary nozzle 30, and while such material remains in a semi-molten state, it is immediately contacted by the co-extrusion material issuing from the discharge slot 39 of the secondary extrusion nozzle. The semi-molten materials bond instantly, joining the tongue-like retaining element 22 to the inner surface of the overlay panel 19 in the manner desired.

As reflected in FIG. 4, the combined extruded materials travel forwardly from the extrusion dies 30, 33 into a calibration die 40. The calibration die 40, in itself known and not a part of the present invention, conforms the extruded strip to its final size and configuration by closing up the various expanded panels and sections of the strip, and preferably also reducing the overall dimensions of the final product.

Typically, the strip material 41 exiting from the calibration nozzle 40, is maintained under linear tension, by any suitable means (not shown) located downstream of the illustration of FIG. 4. Thus, the still-soft material in the region 42, between the extrusion nozzles 30, 33 and the calibration die 40, is under controlled tension, causing the material to be elongated and somewhat reduced in size, and then configured to its final cross sectional shape in the calibration die 40.

In the illustrated arrangement, the calibration die discharges the material 41 into a cooling bath 43 to completely solidify and harden the extrusion materials. As the extruded strip continues downstream, it typically is cut into desired lengths, for example, four feet, for attachment to standard merchandise display shelving.

The two-stage extrusion technique of the invention enables the co-extrusion of a relatively elongated tongue-like retaining element, which is functionally superior to merely co-extruding a soft bead or surface area on the overlay panel 19. The soft flexible tongue-like element is easily displaced by upward pressure on a tag element 27, yet provides highly effective retention of the tag in its installed position.

By co-extruding the soft tongue cross section with the primary strip material immediately upon its emergence from the primary extrusion die, it is possible to retain the integrity and cross sectional configuration of the delicate tongue-like element. The secondary extrusion is performed while the clip area 18–20 of the strip is in an open or expanded configuration, accommodating the presence of the secondary nozzle to extrude the tongue-like element. Later, as the strip passes through the calibrating die, the clip area of the strip is closed to the configuration of FIG. 1, with the outer end extremity 24 of the tongue-like element lightly contacting the upper panel margin 18.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A one-piece extruded plastic data strip for attachment to a front of a standard 48 inch store shelving unit, along a full length thereof, for displaying pricing and other information on said store shelving and of the type having a clear front panel, a back panel integrally joined to said front panel along bottom edges of both panels to form a label pocket, and an integrally extruded sign clip portion extending continuously along an upper edge of said front panel throughout the length of said label data strip, wherein (a) said continuously extending sign clip portion has a back wall portion formed at an upper edge margin of said front panel and further includes a forwardly projecting top connecting portion, joined integrally with said back wall portion, and a downwardly extending overlay panel joined integrally at an upper portion thereof with said top connecting portion and spaced a short distance in front of said back wall portion, (b) said data strip being formed principally of relatively rigid plastic material and having a height and having a length of approximately 48 inches, which is a large multiple of its height and is suitable for attachment across the full length of said standard shelving unit, (c) a thin flexible retaining element of softer plastic material joined by co-extrusion with an inner surface of one of said back wall portion or said overlay panel and extending toward an opposite side of said sign clip along the full length of said data strip, (d) said thin flexible element having a cross sectional configuration including a length in the generally front to back direction and a thickness and wherein its said length is substantially greater than its said thickness, (e) said overlay panel defines with said back wall portion an opening for the reception of an upper margin of a sign tag of predetermined thickness, (f) the width of said opening, in a front to back direction, being greater than the thickness of said sign tag, (g) said thin flexible retaining element being positioned below said top connecting portion and having an end portion engageable with the sign tag when the sign tag is inserted upwardly through said opening to resiliently hold said sign tag in said sign clip portion, (h) the entire data strip, including said front and back panels, and said continuously extending integral sign clip portion, constituting a one-piece extrusion of plastic material.

2. A data strip for displaying pricing and other information on store shelving and of the type having a clear front panel, a back panel integrally joined to said front panel along bottom edges of both panels to form a label pocket, and an integral sign clip portion extending continuously along an upper edge of said front panel throughout the length thereof, wherein (a) said continuously extending sign clip portion is formed in part by an upper edge margin of said front panel and further includes a forwardly projecting top connecting portion, joined integrally with said upper edge margin, and a downwardly extending overlay panel joined integrally at an upper portion thereof with said top connecting portion, (b) said data strip being formed principally of relatively rigid plastic material and having a height a length which is a large multiple of its height, (c) a thin flexible retaining element of softer plastic material joined by co-extrusion with an inner surface of one of said upper edge margin or said overlay panel and extending toward an opposite side of said sign clip, (d) said thin flexible element having a cross sectional configuration including a length in the generally front to back direction and a thickness and wherein its said length is substantially greater than its said thickness, (e) said overlay panel defines with said front panel an opening for the reception of an upper margin of a sign tag of predetermined thickness, (f) the width of said opening, in a front to back direction, is greater than the thickness of said sign tag, (g) said thin flexible retaining element being positioned above said opening and having an end portion engageable with the sign tag inserted upwardly through said opening to resiliently hold said sign tag in said sign clip portion, (h) said thin flexible retaining element extending from one side substantially into contact with an opposite side of said sign clip, and (i) said opposite side being formed with a projecting rib positioned closely underneath an outer end extremity of said thin flexible retaining element.

* * * * *